United States Patent [19]

De Padova et al.

[11] 4,232,322

[45] Nov. 4, 1980

[54] ANTENNA HAVING RADIATION PATTERN WITH MAIN LOBE OF GENERALLY ELLIPTICAL CROSS-SECTION

[75] Inventors: Salvatore De Padova; Enrico Pagana, both of Turin; Giorgio Rosenga, Collegno, all of Italy

[73] Assignee: CSELT - Centro Studi e Laboratori Telecomunicazioni S.p.A., Turin, Italy

[21] Appl. No.: 961,943

[22] Filed: Nov. 20, 1978

[30] Foreign Application Priority Data

Nov. 25, 1977 [IT] Italy ..... 69656A/77

[51] Int. Cl.[3] ..... H01Q 9/14

[52] U.S. Cl. ..... 343/781 P; 343/781 R; 343/840

[58] Field of Search ..... 343/840, 779, 781 R, 343/837, 761, 781 P

[56] References Cited

FOREIGN PATENT DOCUMENTS 1293255 4/1969 Fed. Rep. of Germany ..... 343/840

2263248 6/1974 Fed. Rep. of Germany ..... 343/840

OTHER PUBLICATIONS

Inoue, Takeo et al. "Circularly Polarized Parabolic Antenna" Review of the Electrical Communication Laboratories Vol. 19 May–Jun. 1971.

*Primary Examiner*—David K. Moore

*Attorney, Agent, or Firm*—Karl F. Ross

[57] ABSTRACT

An antenna designed to emit a beam of generally elliptical cross-section has a reflector with a parabolic-elliptical concave surface conforming to the formula $$(x/p)+(y/q)=2z$$

where p and q are the parameters of its parabolic cross-section in the xz and yz planes, respectively. A microwave feed located on a line interconnecting the foci of these two parabolas, preferably at the outer focus separated from the surface vertex by a distance q/2, generates a beam parallel to the axis whose ellipticity depends on the ratio q/p.

6 Claims, 11 Drawing Figures

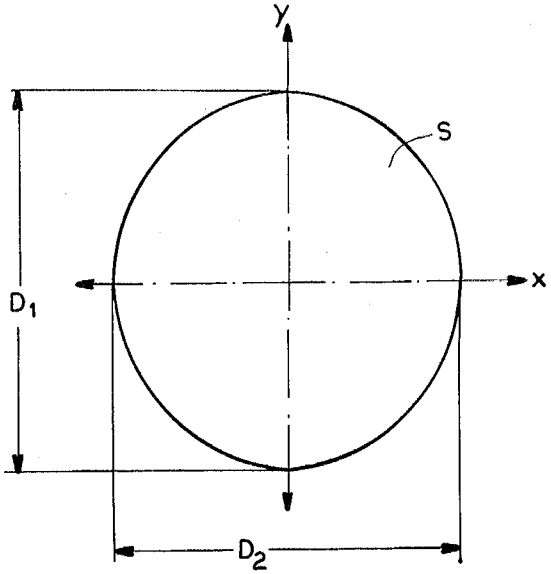
FIG.1B
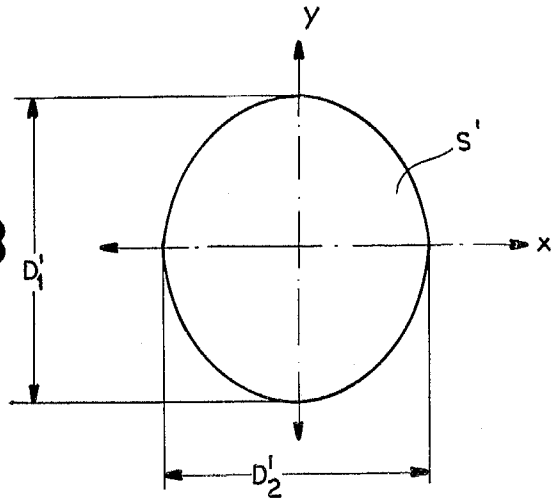
FIG.2B
FIG.1A
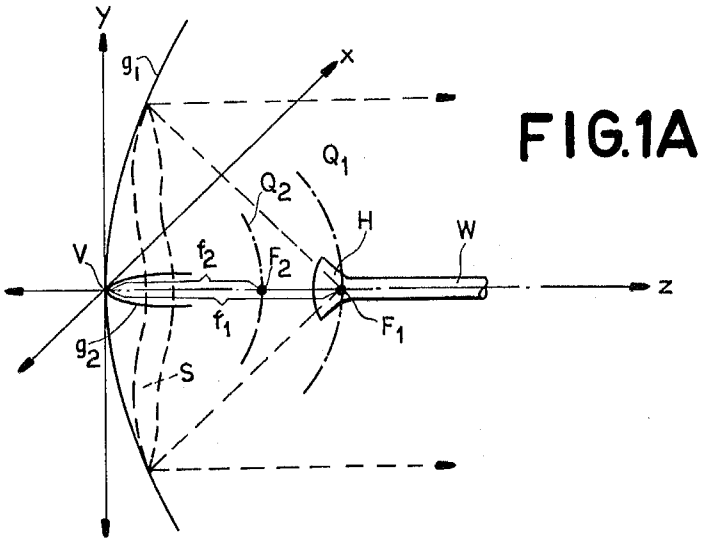
FIG 2A
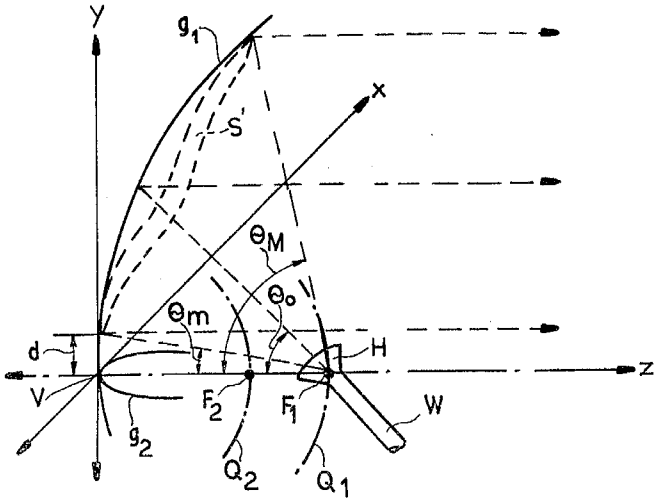

ANTENNA HAVING RADIATION PATTERN WITH MAIN LOBE OF GENERALLY ELLIPTICAL CROSS-SECTION

FIELD OF THE INVENTION

Our present invention relates to a microwave antenna of the type wherein a radiation feed—ideally a point source—illuminates a reflector to produce a beam of predetermined shape.

BACKGROUND OF THE INVENTION

It is frequently useful, especially for satellite communication, to provide a beam of generally elliptical cross-section having different widths in two mutually orthogonal planes. The reduction of the beam width in one of these planes, with maintenance of a desired spread in the other plane, saves energy and minimizes interference with radiation from other sources.

There are several ways of controlling the shape of a beam representing the major lobe of a radiation pattern. One method is based on the structure of the primary source or feed and involves an intricate shaping of the feed aperture, a multimode excitation of the feed or the use of several sources excited in a predetermined phase and amplitude relationship. A second method uses a reflector shaped according to optical principles which, in their application to microwave transmission, generally require a subdivision of the reflecting surface into discrete points or lines conforming to certain geometrical relationships. The construction of such a reflector is difficult since, aside from its electromagnetic performance, it must likewise satisfy certain mechanical requirements in order to have the necessary structural stability. There is also the possibility of providing the reflector with a shield leaving an aperture of the desired shape, yet this expedient alone is usually unsatisfactory and must generally be supplemented by other measures of the type referred to above.

OBJECTS OF THE INVENTION

The principal object of our present invention is to provide a microwave antenna for emitting a beam of generally elliptical cross-section which obviates the aforementioned drawbacks.

A more particular object is to provide an antenna of this type whose reflecting surface conforms to a geometrical law enabling a ready adaptation to existing requirements through the choice of suitable parameters.

It is also an object of our invention to provide an antenna enabling the simultaneous emission of several beams with little or no mutual interference.

SUMMARY OF THE INVENTION

We realize these objects, in accordance with the present invention, by the provision of a reflector with a concave surface whose cross-sections in two mutually orthogonal planes, i.e. the xz and xy planes of a Cartesian co-ordinate system having its origin at the vertex of that surface, substantially define segments of respective parabolas having different foci on a common axis, namely the z axis of the system. A source of microwaves, trained upon that concave surface, is located with its phase center of radiation substantially on a line interconnecting these foci along the common axis or at some other point in a zone bounded by two imaginary spherical surfaces which are centered on the vertex and respectively include the two foci.

The concave surface of such a reflector can be defined by a continuous function, given by the equation $$(x^2/p)+(y^2/q)=2z \tag{1}$$

where p and q are the parameters of its parabolic sections in the xz and yz planes, respectively. Any intersection of that surface with a plane transverse to the z axis is an ellipse whose half-axes are given by $\sqrt{2pz}$ and $\sqrt{2qz}$, respectively.

BRIEF DESCRIPTION OF THE DRAWING

The above and other features of our invention will now be described in detail with reference to the accompanying drawing in which:

FIG. 1A is a diagrammatic view of an axially fed reflector antenna according to our invention;

FIG. 1B shows a projection of the aperture of the reflector of FIG. 1A, i.e. the area illuminated by its feed;

FIGS. 2A and 2B are views analogous to FIGS. 1A and 1B but relating to a reflector antenna with offset feed;

SPECIFIC DESCRIPTION

In FIG. 1A we have schematically indicated a primary source of microwaves, in the form of a horn H connected to a waveguide W, radiating toward a dished reflector with a parabolic-elliptical concave surface having a vertex V at the origin of a co-ordinate system with axes x, y and z. The effective reflector surface, defined by equation (1) given above, has a generatrix $g_1$ in the yz plane and a generatrix $g_2$ in the xz plane. These two generatrices are segments of respective parabolas with foci $F_1$ and $F_2$ on the z axis which in this instance is also the axis of the feed H; foci $F_1$ and $F_2$ are spaced from vertex V by respective distances $f_1$ and $f_2$. The phase center of the feed is here shown to coincide with the focus $F_1$ more remote from the vertex. The parameters p and q of equation (1) are given by:

$$p=2f_2 \tag{2}$$

$$q=2f_1 \tag{3}$$

Figure 1D:
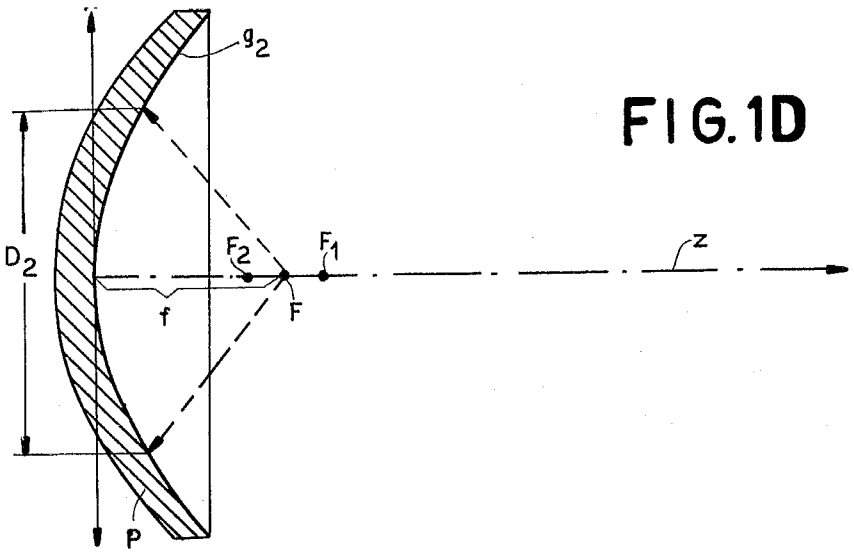
FIG. 1D is a cross-sectional view of the same reflector taken in the xz plane of the co-ordinate system.
Figure 1C:
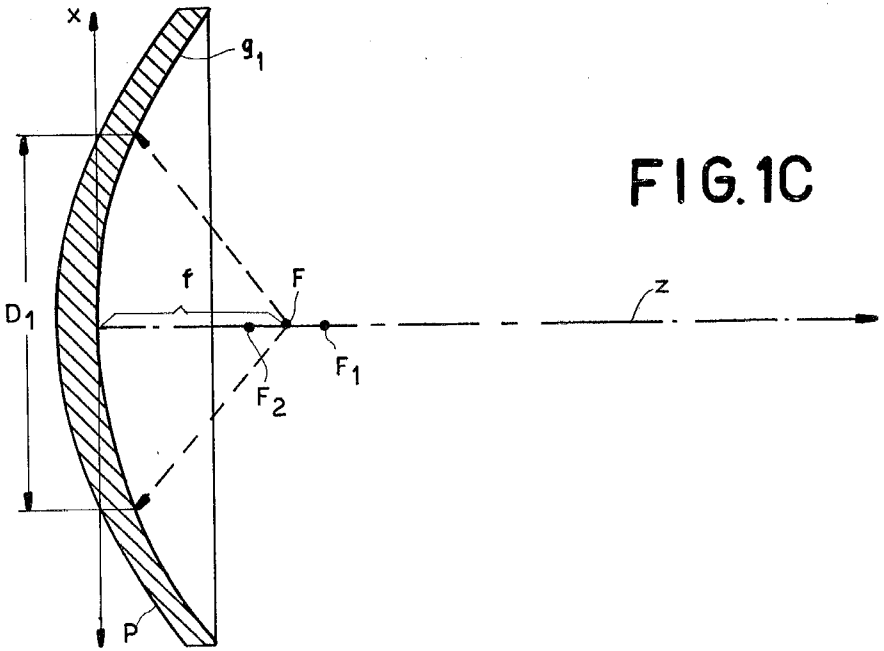
FIG. 1C is a cross-sectional view of the reflector of FIG. 1A taken in the yz plane of an associated co-ordinate system.

FIGS. 1C and 1D show the reflector P in section together with a cone of radiation whose apex is a point F located on the line between foci $F_1$ and $F_2$ at a distance f from vertex V. With $f=f_1$ as in FIG. 1A, applying the principles of conventional optics, one would expect the rays from focus $F_1$ to be reflected parallel to the z axis by the corresponding parabolic segment $g_1$ of FIG. 1C but to converge toward that axis upon being reflected by the parabolic segment $g_2$ in FIG. 1D. Surprisingly, this is not the case with microwave radiation as more fully discussed hereinafter.

The area S illuminated on the concave reflector surface, as projected upon a plane transverse to the z axis, has been illustrated in FIG. 1B. The outline of that area is a three-dimensional curve as seen in FIG. 1A; its projection approaches an ellipse with diameters $D_1$ and $D_2$ along axes y and x, respectively.

In FIG. 2A the feed H still coincides with focus $F_1$ but its axis has been inclined at an angle $\theta_o$ with reference to the z axis. The radiated cone has a vertex angle of $\theta_M-\theta_m$ ($\theta_M$ and $\theta_m$ being the angles of inclination of the generatrices farthest from and nearest to the axis) so that the area S' is spaced from the vertex V by a distance $d \approx f_1 \cdot \sin\theta_m$. This arrangement is preferred over that of FIG. 1A since it avoids any obstruction of the reflected beam by the feed; otherwise, the two systems are substantially equivalent.

The illuminated area S', projected upon a plane transverse to the z axis, has been illustrated in FIG. 2B and is also of quasi-elliptical shape with diameters $D'_1$ and $D'_2$ along axes y and x, respectively.

Figure 3:
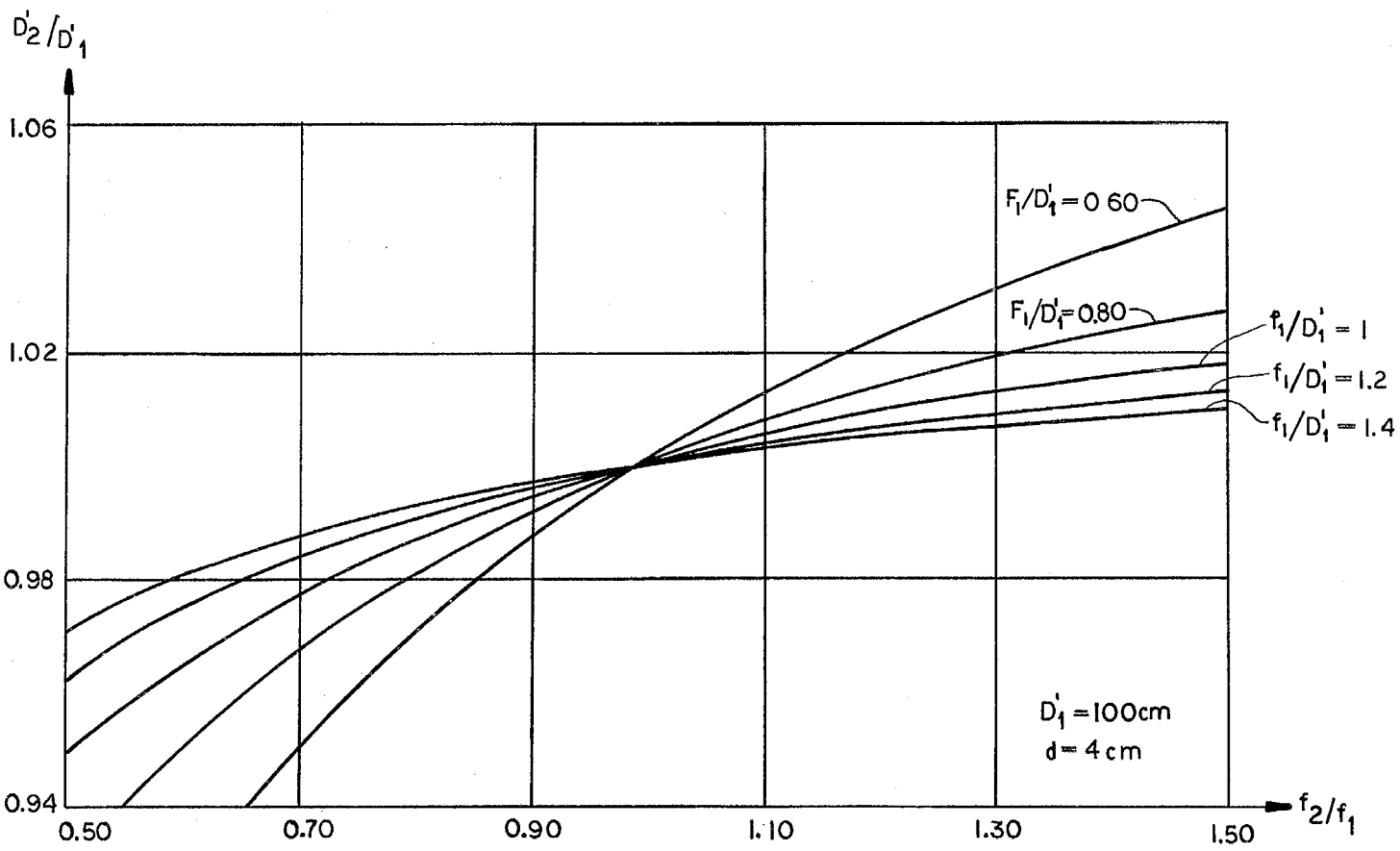
FIG. 3 is a graph comprising a family of curves relating to the ellipticity of the projection shown in FIG. 2B.

Even with a large difference between focal distances $f_1$ and $f_2$, as here shown, the corresponding diametrical ratio $D'_2/D'_1$ differs but little from unity, especially with a vertex angle for which the inverted aperture ratio $f_1/D'_1$ (or $f_1/D_1$) is equal to or greater than 1. This has been illustrated in FIG. 3 for various parabolic-elliptical reflector surfaces, illuminated from focus $F_1(f=f_1)$, with different ratios $f_1/D'_1$ and with $d/D'_1=0.04$; in this specific instance, the diameter $D'_1$ was 100 cm and the offset d was 4 cm. FIG. 3, where the diametrical ratio $D'_2/D'_1$ is plotted against focal ratio $f_2/f_1$, shows that for any value of $f_2/f_1$ greater than 1 (i.e. with the feed located at $F_1$ to the left of focus $F_2$ in FIG. 2A) the two diameters differ very little from each other even though the resultant beam is of pronounced elliptical cross-section.

Figure 4:
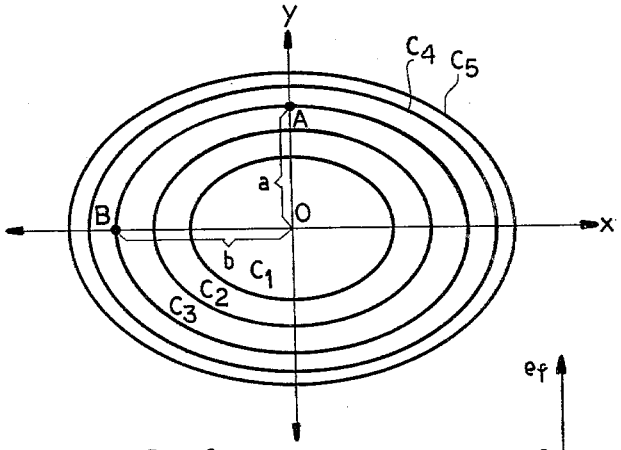
FIG. 4 is a set of contour lines representing the energy levels of the main lobe of a radiation pattern emitted by the antenna of FIG. 2A.

The shape of that cross-section, again for the feed position of FIG. 2A, has been illustrated in FIG. 4 by a set of generally elliptical contour lines $C_1$–$C_5$ representing the main lobe of the emitted radiation pattern at various energy levels differing from the maximum level at the center 0 of the array by −1, −2, −3, −4 and −5 dB, respectively. The ellipticity of the beam section is measured at the level of −3 dB, represented by curve $C_3$, as the ratio of half-axes a and b disposed in planes yz and xz, respectively, between center 0 and vertices A, B. That ellipticity $e_f$ has been plotted in FIG. 5 against focal ratio $f_2/f_1$ for a unity aperture ratio ($f_1/D'_1=1$) and with d=6 cm under conditions otherwise corresponding to those specified for the middle curve in FIG. 3. A comparison of the latter curve with that of FIG. 5 reveals that for a given focal ratio $f_2/f_1$ the ellipticity $e_f$ is a fractional value substantially smaller than the corresponding diametrical ratio $D'_2/D'_1$. With $f_2/f_1=0.9$, for example, we find $D'_2/D'_1=0.994$ and $e_f=0.74$.

Thus, the shape of the outgoing beam is determined not so much by the geometry of the aperture as by the phase distribution of the microwaves striking the reflector surface within the aperture area S or S'. That phase distribution is a function of $(f_1-F_2)/\lambda$, where $\lambda$ is the operating wavelength, and varies with the cosine of the angle of inclination $\theta$ whose limiting values $\theta_m$ and $\theta_M$ are shown in FIG. 2A.

Figure 5:
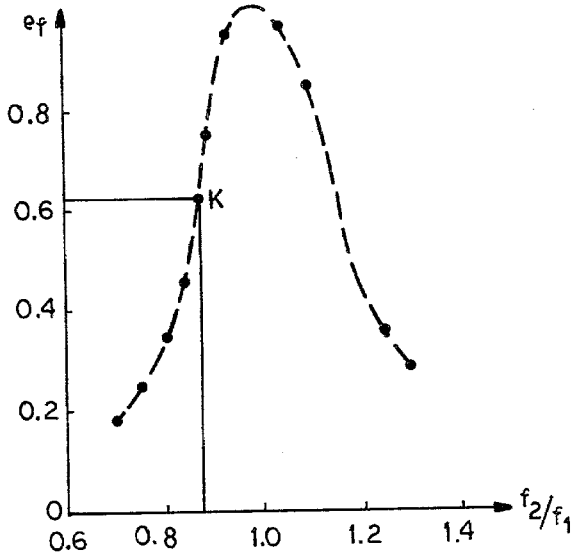
FIG. 5 is a graph showing the relationship between the ellipticity of the main lobe and the reflector configuration of FIG. 2A.

From FIG. 5 it will be apparent that the ellipticity $e_f=a/b$ is a fractional value whenever $f_1 \neq f_2$, regardless of the relative position of foci $F_1$ and $F_2$ along the z axis. Thus, the beam invariably has its minimum width in the yz plane, i.e. the plane in which the reflector section is a segment of a parabola whose focal point is the phase center of radiation. In the conventional case of $f_1=f_2$, of course, the beam is of circular cross-section with $e_f=1$.

Figure 6:
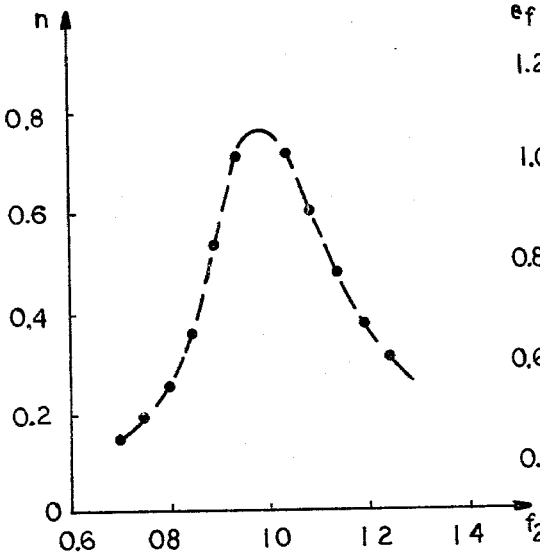
FIG. 6 is a graph showing the relationship between antenna efficiency and reflector configuration.

The curve of FIG. 6 represents the antenna efficiency $\eta$ as plotted against the focal ratio $f_2/f_1$ under the conditions given for FIG. 5. It will be noted that this efficiency is a maximum for the conventional case in which that focal ratio is unity, decreasing more or less symmetrically on both sides of that value.

Figure 7:
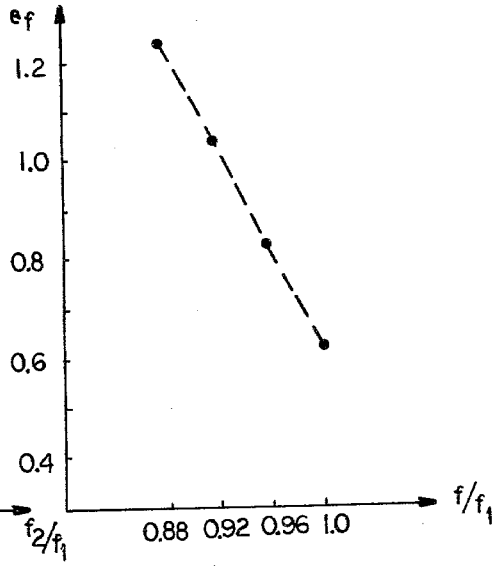
FIG. 7 is a graph showing the relationship between ellipticity and the position of the feed in FIG. 2A.

In FIG. 7 we have plotted the ellipticity $e_f$ for different positions of the feed along the line $F_1$–$F_2$, again with $f_1/D'_1=1$ for the case in which $f=f_1$ as said in connection with the preceding Figures. The reflector used in this instance has a focal ratio $f_2/f_1=0.88$, corresponding to a point K on the curve of FIG. 5 for which $e_f=0.62$; in FIG. 7 this point K pertains to the feed position $f/f_1=1$. When the feed is moved along the z axis to point $F_2$, i.e. in the position $f/f_1=0.88$, the ellipticity $e_f$ assumes a value greater than 1; this means that a>b in FIG. 4, with the narrow waist of the beam now lying in the xz plane in conformity with the foregoing observation concerning the shape of its cross-section. In an intermediate feed position, with $f/f_1 \approx 0.92$, the curve of FIG. 7 passes through a value of unity for ratio a/b representing a main lobe of substantially circular cross-section.

Up to now, we have considered only cases in which the feed is located on the reflector axis z. An antenna according to our invention can also be used, however, with an off-axial source of radiation located at a distance $f_2 \leq f \leq f_1$ from vertex V, i.e. within a zone bounded by two concentric spherical shells $Q_1$ and $Q_2$ shown in FIGS. 1A and 2A. The beam in that case is no longer parallel to the z axis but has a squint depending on the feed position.

In designing a reflector antenna according to our invention, on the basis of a desired ellipticity $e_f$ for the main lobe of the radiation pattern, we may start with the curve of FIG. 5 which yields two mutually reciprocal values for the focal ratio $f_2/f_1$ corresponding to that ellipticity. Generally, these two focal ratios will yield different values for the antenna efficiency $\eta$ plotted in FIG. 6; usually, the value corresponding to higher efficiency will be chosen.

The antenna gain G is given by the well-known relationship $$G=4\pi\eta S'/\lambda^2 \tag{4}$$

where S' is the aperture area of FIG. 2B and $\lambda$ is the wavelength of the emitted radiation. For a given wavelength $\lambda$ (e.g. of 2.5 cm) and with the efficiency of $\eta$ already specified, a desired gain G requires a certain area S' which is a function of diameters $D'_1$ and $D'_2$. As the diametrical ratio $D'_2/D'_1$ is determined from the focal ratio $f_2/f_1$, e.g. by the middle curve at FIG. 3 representing the aperture ratio $f_1/D'_1=1$ which underlies the graphs of FIGS. 5 and 6, the absolute values of diameters $D'_1$ and $D'_2$ are unequivocally established; this, in turn, provides the absolute values for the focal distances $f_1$ and $f_2$ along with the parameters $p=2f_2$ and $q=2f_1$ of equation (1) defining the concave reflector surface.

The shape of the feed H is not critical, yet a circularly symmetrical emission of cylindrical or conical configuration (such as the cones shown in FIGS. 1A and 2A) is desirable to minimize the contribution of cross-polarization. Thus, the microwave source may be a cylindrical or conical radiator, preferably with a corrugated inner surface.

If it is desired to use our improved antenna for the generation of a plurality of beams differing in direction and possibly also in ellipticity $e_f$, several sources may be disposed within the zone bounded by the two spherical shells $Q_1$ and $Q_2$ of respective radii $f_1$ and $f_2$ centered on vertex V. The position of each source relative to axis z then determines the direction of the respective beam whose ellipticity is given by the distance f of its source from the vertex.

We claim:

1. An antenna having a radiation pattern with a main lobe of generally elliptical cross-section, comprising:

a reflector with a concave surface whose cross-sections in two mutually orthogonal planes substantially define segments of respective parabolas of different parameters p and q with $p \neq q$, said parabolas having a common vertex and different foci on a common axis passing through said vertex, said surface intersecting a plane transverse to said common axis in a generally elliptical curve; and a source of microwaves trained upon said concave surface, said source being located with its phase center of radiation in a zone bounded by two imaginary spherical surfaces of respective radii p/2 and q/2 centered on said vertex and passing through said foci, thereby establishing a radiation pattern with a main lobe of generally elliptical cross-section.

2. An antenna as defined in claim 1 wherein said phase center lies on a line interconnecting said foci.

3. An antenna as defined in claim 2 wherein said phase center coincides with the focus more remote from said vertex.

4. An antenna as defined in claim 1, 2, or 3 wherein said concave surface is defined by a continuous function.

5. An antenna as defined in claim 4 wherein said function substantially conforms to the equation $$(x^2/p)+(y^2/q)=2z$$

where x, y and z are the axes of a co-ordinate system having its origin at said vertex, said common axis being the z axis of said co-ordinate system.

6. An antenna as defined in claim 5 wherein said source has a radiation cone illuminating an area of said concave surface offset from said z axis.

* * * * *